US008098862B2

(12) United States Patent
Koch et al.

(10) Patent No.: US 8,098,862 B2
(45) Date of Patent: Jan. 17, 2012

(54) HEARING APPARATUS WITH A SPECIAL CHARGING CIRCUIT

(75) Inventors: Frank Koch, Erlangen (DE); Thomas Lotter, Nürnberg (DE); Uwe Rass, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 972 days.

(21) Appl. No.: 12/077,667

(22) Filed: Mar. 20, 2008

(65) Prior Publication Data

US 2008/0232625 A1 Sep. 25, 2008

(30) Foreign Application Priority Data

Mar. 20, 2007 (DE) ..... 10 2007 013 420

(51) Int. Cl.
*H04R 25/00* (2006.01)

(52) U.S. Cl. ..... 381/323; 381/313; 381/314

(58) Field of Classification Search ..... 381/313, 381/314, 323, 81

See application file for complete search history.

(56) References Cited

U.S. PATENT DOCUMENTS 6,143,440 A 11/2000 Volz et al.

FOREIGN PATENT DOCUMENTS

| | | | |
|---|---|---|---|
| DE | 198 37 909 | C2 | 2/2000 |
| EP | 1458110 | A2 | 9/2004 |
| WO | WO 2006126881 | A2 | 11/2006 |

*Primary Examiner* — Steven Loke
*Assistant Examiner* — Kimberly M Thomas

(57) ABSTRACT

Provisions to charge the battery of a hearing apparatus without having to remove the battery from the housing are provided. A hearing apparatus separates charging contacts, which are disposed on the surface of the housing and serve to charge the battery, from the battery and to connect the battery to an amplifier circuit, when the battery is not being charged. Otherwise, when the battery is being charged, the hearing apparatus connects the charging contacts to the battery and separates the battery from the amplifier circuit. This double switching function means that the amplifier circuit is protected from charging power surges and also in the normal operating state of the hearing apparatus electrochemical reactions at the charging contacts are avoided.

10 Claims, 1 Drawing Sheet

HEARING APPARATUS WITH A SPECIAL CHARGING CIRCUIT

CROSS REFERENCE TO RELATED APPLICATIONS

This application claims priority of German application No. 10 2007 013 420.9 DE filed Mar. 20, 2007, which is incorporated by reference herein in its entirety.

FIELD OF INVENTION

The present invention relates to a hearing apparatus with a housing, a rechargeable battery in the housing, an amplifier circuit, which is supplied with power by the battery and which is likewise located in the housing, as well as charging contacts, which are disposed on the surface of the housing, to charge the battery. A hearing apparatus here refers in particular to a device worn on the ear, for example a hearing device, a headset and headphones.

BACKGROUND OF INVENTION

Hearing devices are wearable hearing apparatuses, which serve to assist people with hearing impairments. To meet the many individual needs, there are different models of hearing devices, such as behind the ear hearing devices (BTE) and in the ear hearing devices (ITE), for example also concha hearing devices or completely in the canal hearing devices (CIC). The hearing devices listed by way of example are worn on the outer ear or in the auditory canal. Also available on the market however are bone conduction aids and implantable or vibrotactile hearing aids. With these the impaired hearing is stimulated either mechanically or electrically.

SUMMARY OF INVENTION

The essential components of hearing devices are basically an input converter, an amplifier and an output converter. The input converter is generally a sound receiver, e.g. a microphone, and/or an electromagnetic receiver, e.g. an induction coil. The output converter is generally realized as an electroacoustic converter, e.g. a miniature converter is generally realized as an electroacoustic converter, e.g. a miniature loudspeaker, or as an electromechanical converter, e.g. a bone conduction receiver. The amplifier is generally integrated in a signal processing unit. This basic structure is shown by way of example in FIG. 1 in the form of a behind the ear hearing device. One or more microphones 2 to pick up the sound from the surroundings is/are incorporated in a hearing device housing 1 that is worn behind the ear. A signal processing unit 3, which is likewise integrated in the hearing device housing 1, processes the microphone signals and amplifies them. The output signal of the signal processing unit 3 is transmitted to a loudspeaker or receiver 4, which outputs an acoustic signal. In some instances the sound is transmitted to the eardrum of the hearing device wearer by way of a sound tube, which is fixed with an otoplastic in the auditory canal. The power supply to the hearing device and in particular the power supply to the signal processing unit 3 are provided by a battery 5 likewise integrated in the hearing device housing 1.

By their nature hearing devices are relatively small in size. Their batteries and the battery compartments, in which the batteries are housed in the hearing devices, are also correspondingly small. Many hearing device wearers find it difficult to handle these small batteries and battery compartments. It is therefore generally desirable for it to be possible to charge rechargeable batteries in hearing devices without having to remove said batteries. However in order to introduce a defined energy into the battery, the hearing device must be switched off, so that the hearing device circuit receives no power or only minimum power. It is also favorable if the hearing device chip is separated from the battery during the charging process, so that it is not damaged by power surges. At the end of the charging process the hearing device should be switched on again automatically, if possible, immediately after removal from the charging device.

To date hearing devices have been known, in which the charging device makes contact with the battery by way of two pins in the hearing device housing for charging purposes. The hearing device is switched off during charging, in that the battery is loaded so that the voltage at the hearing device chip drops to below a disconnect threshold. After charging the hearing device is switched on by opening and closing the battery compartment. The hearing device chip is connected to the battery during charging. Charge voltages outside the chip specification are avoided by a slower charging method.

The pins for charging the battery on the hearing device housing also have the disadvantage that electrochemical reactions with substances and materials from the surroundings can take place on their surfaces, with the result that the contacts gradually corrode, having a negative effect on the quality of the electrical connection.

A rechargeable battery for hearing devices is also known from the publication US 2005/0095498 A1. The battery is charged directly in the hearing device and has its own inductive charging circuit. The hearing device is switched off automatically, when the battery is in charge mode. However the fact that it has its own charging circuit means that such a battery is relatively expensive.

A contact arrangement for contact between an earpiece of a hearing device and a spectacle arm is known from the publication WO 2006/126881 A2. The processor of the hearing device is supplied with power by a rechargeable battery. The charging contacts of the battery serve as output contacts of the processor at the same time. The output signals are conducted from there to a loudspeaker. A switch can be used to switch the charging contacts to function as output contacts.

The patent DE 198 37 909 C2 also discloses a protective apparatus for a multiply rechargeable electrochemical battery for implantable hearing apparatuses. The protective apparatus has a number of switching elements, which can be activated subject to control by a detector element. The detector element detects a non-permissible operating state of the battery and initiates corresponding switching processes.

The object of the present invention is therefore to embody the charging of a battery of a hearing apparatus in a reliable and simple manner, avoiding electrochemical reactions at charging contacts as far as possible.

According to the invention this object is achieved by a hearing apparatus with a housing, a rechargeable battery in the housing, an amplifier circuit, which is supplied with power by the battery and which is likewise located in the housing, as well as charging contacts, which are disposed on the surface of the housing, to charge the battery, and a switching facility to separate the charging contacts electrically from the battery and to connect the battery to the amplifier circuit, when the battery is not being charged, and to connect the charging contacts electrically to the battery and to separate the battery from the amplifier circuit, when the battery is being charged.

Advantageously it is thus possible to separate the charging contacts from the battery of the hearing apparatus, when the battery is not being charged, so that electrochemical reactions at the charging contacts are avoided. Likewise the inventive switching facility ensures that the amplifier circuit is separated from the battery, when the battery is being charged, so that the amplifier circuit or the corresponding integrated circuit is protected from charging power surges.

The switching facility preferably comprises a separate first switch to separate/connect the charging contacts from/to the battery and a separate second switch to separate/connect the amplifier circuit from/to the battery. These switches can be realized either by electronic switches or by mechanical switches. Alternatively the two switches can also be formed by a change-over switch.

According to a special embodiment the first switch can have a Schottky diode. When there is sufficient voltage this diode allows a current, while when no charging voltage is applied, the diode prevents a current flowing into the charging contacts for an electrochemical reaction.

The switching facility can also have a current detector to detect a current from a charging device and to control the switching processes as a function of the detected current. With the current detector it is possible to detect reliably that a charging device is connected to the charging contacts.

According to a further embodiment provision can be made for the switching facility to separate the charging contacts from the battery, when the detected current drops below a predetermined threshold value. This makes is possible to guarantee a defined charging of the battery.

Provision can also be made for the switching facility to connect the amplifier circuit to the battery, when the detected current drops below a predetermined threshold value. In this situation it should be assumed that the battery should no longer be charged and the hearing apparatus should instead be used automatically for its intended purpose.

BRIEF DESCRIPTION OF THE DRAWINGS

The present invention is described in more detail with reference to the accompanying drawings, in which.

DETAILED DESCRIPTION OF INVENTION

The exemplary embodiment described in more detail below represents a preferred embodiment of the present invention.

Figure 1:
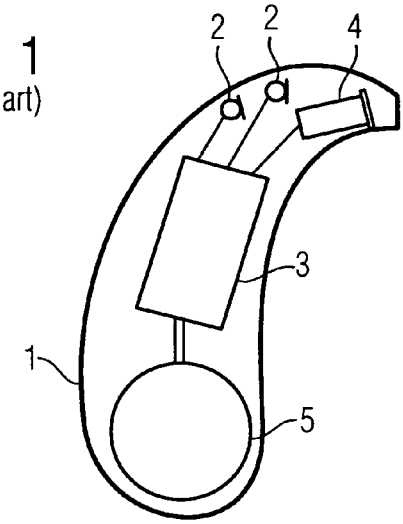
FIG 1 (Prior art)
FIG. 1 shows the basic structure of a hearing device according to the prior art.
Figure 2:
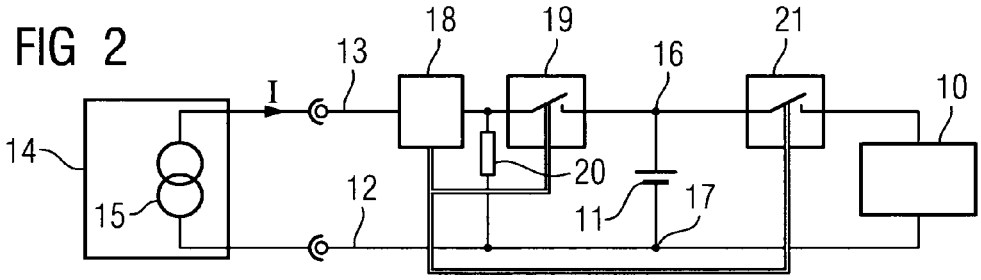
FIG. 2 shows a schematic circuit diagram of an inventive hearing device electronic system.

FIG. 2 shows a hearing device chip 10 for a hearing device symbolically, said hearing device chip 10 having the functionality of an amplifier for example. The hearing device also has a rechargeable battery 11, which is connected both to the hearing device chip 10 and the charging contacts 12, 13. The charging contacts 12, 13 can be embodied as contact pins or contact bushes, which are disposed on the surface of the hearing device housing.

A charging device 14 with a power source 15 can be connected to the charging contacts 12, 13. This supplies a charging current I.

When the battery 11 is being charged, it should be connected to the contact pins and/or charging contacts 12, 13. According to the example in FIG. 2 the battery 11 is located between two electrical nodes 16 and 17. The latter is connected directly to the one charging contact 12. A current detector 18 and a switch 19 are connected in series between the other charging contact 13 and the node 16. The current detector 18 controls the switch 19. So that the current detector 18 can detect a current even when the switch 19 is in the opened state, a high-resistance resistor 20 is present between the input of the switch 19 and the node 17.

The node 16 is also connected to the input of a second switch 21, whose output is in contact with the hearing device chip 10. For the supply of power the hearing device chip 10 is also connected directly to the node 17. The second switch 21 is likewise controlled by way of the current detector 18. The two switches 19 and 21 can advantageously be realized as transistor switches on the hearing device chip 10.

Figure 3:
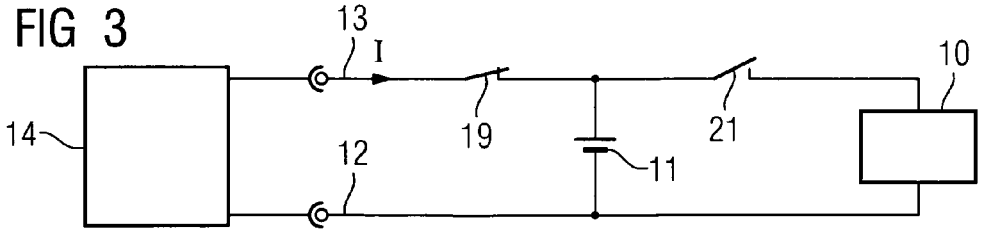
FIG. 3 shows the state of the circuit in FIG. 2 during charging.

The switches 19, 21 are controlled as a function of the current I, which is emitted from the charging device 14 into the hearing device. If the current is above a threshold $I_S$ (e.g. 100 μa), i.e. $I \geqq I_S$, the switch 19 is closed, so that the current can flow into the battery 11. At the same time the second switch 21 is opened, so that the connection between the battery 11 and hearing device chip 10 is separated. This charging state is shown simplified in FIG. 3. It can clearly be seen that while the battery 11 is being charged, the hearing device is switched off, because the hearing device chip 10 is separated from the battery 11.

Figure 4:
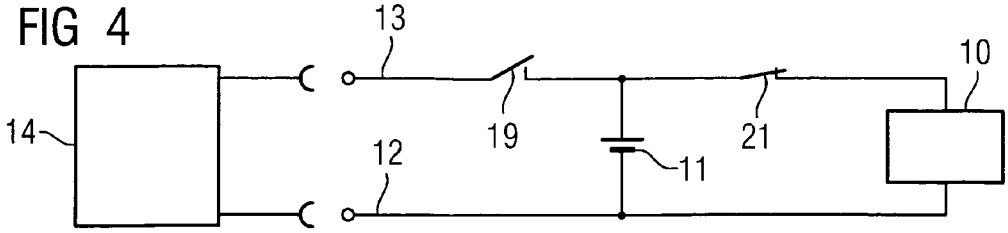
FIG. 4 shows the state of the circuit in FIG. 2 during normal operation of the hearing device.

If the current drops below the stated threshold $I_S$, i.e. $I < I_S$, e.g. because the hearing device is removed from a charger, the second switch 21 between the battery 11 and the hearing device chip 10 closes. The hearing device thus switches itself on. The connection between the battery 11 and the contact pins or charging contacts 12, 13 in the hearing device shell is separated. This operating state is shown similarly simplified in FIG. 4. Because the charging contact 13 is separated from the battery 11 by the first switch 19, no electrochemical reaction can take place at the two charging contacts 12, 13, as they have no potential difference.

As already mentioned above, the first switch 19 can be realized by a Schottky diode in the flow direction from the charging contact 13 to the battery 11. The Schottky diode prevents a significant electrochemical reaction taking place at the charging contacts during operation. The Schottky diode is also bridged by the high-resistance resistor 20, so that a current I can also flow, when the switch 19 is open, i.e. blocks the Schottky diode. In this instance a low voltage can still be measured at the charging contacts 12, 13 but the maximum flowing current is very small.

With the hearing apparatus shown the operating state of the hearing device (on/off) and the charging process is advantageously controlled by the current supplied to the hearing device by way of the contact pins. The hearing device is therefore switched off automatically without mechanical processes by electrical separation of the chip 10 from the battery 11. The hearing device is also switched on automatically when it is removed from the charger.

The specific switching facility allows any charging methods to be implemented, without having to take the chip specification into account, since during charging the chip is separated from the charging device or battery. The battery can therefore be charged at 3 V, even if the hearing device chip 10 is only designed for 1.6 V. Also, as already mentioned, there is no voltage present at the charging contacts 12, 13, while the hearing device is worn, so that electrochemical reactions are avoided, which would develop as electrolyte for example due to sweat.

The invention claimed is:

1. A hearing apparatus, comprising:

a housing;

a rechargeable battery located in the housing;

an amplifier circuit located in the housing and receives power from the battery;

a plurality of charging contacts disposed on a surface of the housing, to charge the battery;

a switching facility that separates the charging contacts electrically from the battery and connects the battery to the amplifier circuit when the battery is not being charged and connects the charging contacts electrically to the battery and to separate the battery from the amplifier circuit, when the battery is being charged.

2. The hearing apparatus as claimed in claim 1, wherein the switching facility comprises a first switch to separate or connect the charging contacts from or to the battery and a separate switch to separate or connect the amplifier circuit from or to the battery.

3. The hearing apparatus as claimed in claim 2, wherein the first switch has a Schottky diode.

4. The hearing apparatus as claimed in claim 1, wherein the switching facility has a current detector that detects a current from a charging device and controls the switching processes as a function of the detected current.

5. The hearing apparatus as claimed in claim 4, wherein the switching facility connects the amplifier circuit to the battery when the detected current drops below a predetermined threshold value.

6. The hearing apparatus as claimed in claim 4, wherein the switching facility separates the charging contacts from the battery when the detected current drops below a predetermined threshold value.

7. A method for charging a hearing apparatus, comprising:

providing a rechargeable battery located in a housing;

providing an amplifier circuit located in the housing, the amplifier receives power from the battery;

providing a plurality of charging contacts disposed on a surface of the housing, to charge the battery;

detecting a current from a charging device;

determining from the current when the battery is being charged;

when determining that the battery is being charged:

connecting the charging contacts electrically to the battery, and separating the battery from the amplifier circuit; and when determined that the battery is not being charged:

separating the charging contacts electrically from the battery, and connecting the battery to the amplifier circuit.

8. The method as claimed in claim 7, wherein a switching facility provides the connecting or separating of the battery and the amplifier and the connecting or separating of the contacts and the battery, and wherein switching facility comprises a first switch to separate or connect the charging contacts from or to the battery and a separate switch to separate or connect the amplifier circuit from or to the battery.

9. The method as claimed in claim 8, wherein the first switch has a Schottky diode.

10. The method as claimed in claim 7, wherein the battery is not being charged when the detected current drops below a predetermined threshold.

* * * * *